US006899050B1

(12) United States Patent
Huang

(10) Patent No.: US 6,899,050 B1
(45) Date of Patent: May 31, 2005

(54) FLEXIBLE ANCHORING ROPE

(76) Inventor: Yun-Peng Huang, 6F., No. 452, Sec 1, Longmi Rd., Bali Township, Taipei County (TW)

( * ) Notice: Subject to any disclaimer, the term of this patent is extended or adjusted under 35 U.S.C. 154(b) by 0 days.

(21) Appl. No.: 10/706,951

(22) Filed: Nov. 14, 2003

(51) Int. Cl.[7] ..... B63B 21/24
(52) U.S. Cl. ..... 114/293
(58) Field of Search ..... 114/293

(56) References Cited

U.S. PATENT DOCUMENTS 6,608,487 B2 * 8/2003 De Angelis ..... 324/539
2002/0176747 A1 * 11/2002 Hanna et al. ..... 405/224
2003/0010966 A1 * 1/2003 Sjostedt ..... 254/231

* cited by examiner

*Primary Examiner*—Jesus D. Sotelo
(74) *Attorney, Agent, or Firm*—Troxell Law Office, PLLC

(57) ABSTRACT

The present invention discloses a flexible anchoring rope for fixing a floating platform in the water, and such anchoring rope is made of a substance consisting of a mixture of rubber and carbon fiber in an appropriate ratio and wrapped inside fibers. The fixtures on both ends of such flexible anchoring rope are used to fix a floating platform to an anchor in the water. By means of the good pre-stressed buffer provided by the flexible anchoring rope, the maximum extensibility is up to 90~120% which can sustain the tension produced by the tidal currents during the rising and ebb tides, and its good resilience can keep the floating platform in a specific area.

11 Claims, 10 Drawing Sheets

FLEXIBLE ANCHORING ROPE

FIELD OF THE INVENTION

The present invention relates to an anchoring rope for fixing a floating platform or pontoon on or in the water, more particularly to a flexible anchoring rope that provides a good pre-stressed buffer to sustain the tension produced by the tidal currents during the rising and ebb tides and a good resilience that can keep the floating platform or pontoon in a certain specific area. This invention can improve the situation of traditional anchoring rope from being broken and the floating platform being drifted away due to the strong waves caused by storms.

BACKGROUND OF THE INVENTION

To expand the living space of a densely populated area, marine space development is used as one of the major measures to expand the use of land. The traditional development on reclamation of lakes, rivers, tidal beach areas, and shallow areas is technically a feasible solution. The population density of Taiwan is very high, and large-scale reclamations of tidal beach areas are completed or ongoing under governmental promotions and guidance. However, the concept of environmental protection gradually comes into place and the drastic changes to the natural environment are regarded as damages to the environment and are objected. Therefore, super large floating platforms at sea can be set in a deeper sea, which has less influence to the costal environment, and minimizes the noise and pollution disturbing our daily life by setting the floating platform or pontoon offshore and away from the densely populated areas. People have quite high expectations on these floating platforms or pontoons. These floating platforms or pontoons are constructional structures made of steel or concrete, forming large floating platforms or pontoons at sea and providing places for people to stay and perform activities. In recent years, many experts have proposed the ideas of floating airports, incinerators at sea, container terminals at sea, and oil refineries at sea, etc. The United States and Japan had invested tremendous resources on the research and development of super large-scale floating platforms or pontoons. The stability, current-resistance, elasticity and load bearing, corrosion-resistance, welding technology, and positioning technology, etc. create a big challenge to the construction of these floating platforms or pontoons due to their super size.

However, waves constitute the most complicated changes to ocean and act as the most damaging external forces to the environment. Regardless of the type of coastal and ocean constructions such as the petroleum production platform, costal migration, sea wall, and bay planning, wave is the major factor for the dynamics design. Therefore, the way of fixing these floating platforms or pontoons at sea become a current important topic.

SUMMARY OF THE INVENTION

The primary objective of the present invention is to provide a flexible anchoring rope for fixing a floating platform or pontoon in or on the water, and such anchoring rope is made of a substance consisting of a mixture of rubber and carbon fiber in an appropriate percentage composition and wrapped inside fibers. The fixtures on both ends of such flexible anchoring rope are used to fix a floating platform or pontoon to an anchor in or on the water. By means of the good pre-stressed buffer provided by the flexible anchoring rope, the maximum extensibility is up to 90~120% which can sustain the tension produced by the tidal currents during the rising and ebb tides, and its good resilience can keep the floating platform in a certain specific area.

More particularly, the structure of a flexible anchoring rope is made of a first layer of rubber with synthetic carbon fibers, a first layer of fibers, a second layer of rubber with synthetic carbon fibers, a second layer of fibers, and a third layer of rubber with synthetic carbon fibers in the sequence from inside out; wherein the percentage of synthetic carbon fiber content is about 40~50%, which can give the flexible anchoring rope better extensibility, tension-resistance, and resilience to enhance the stability and current-resistance of the floating platforms at sea.

BRIEF DESCRIPTION OF THE DRAWINGS

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

Figure 1:
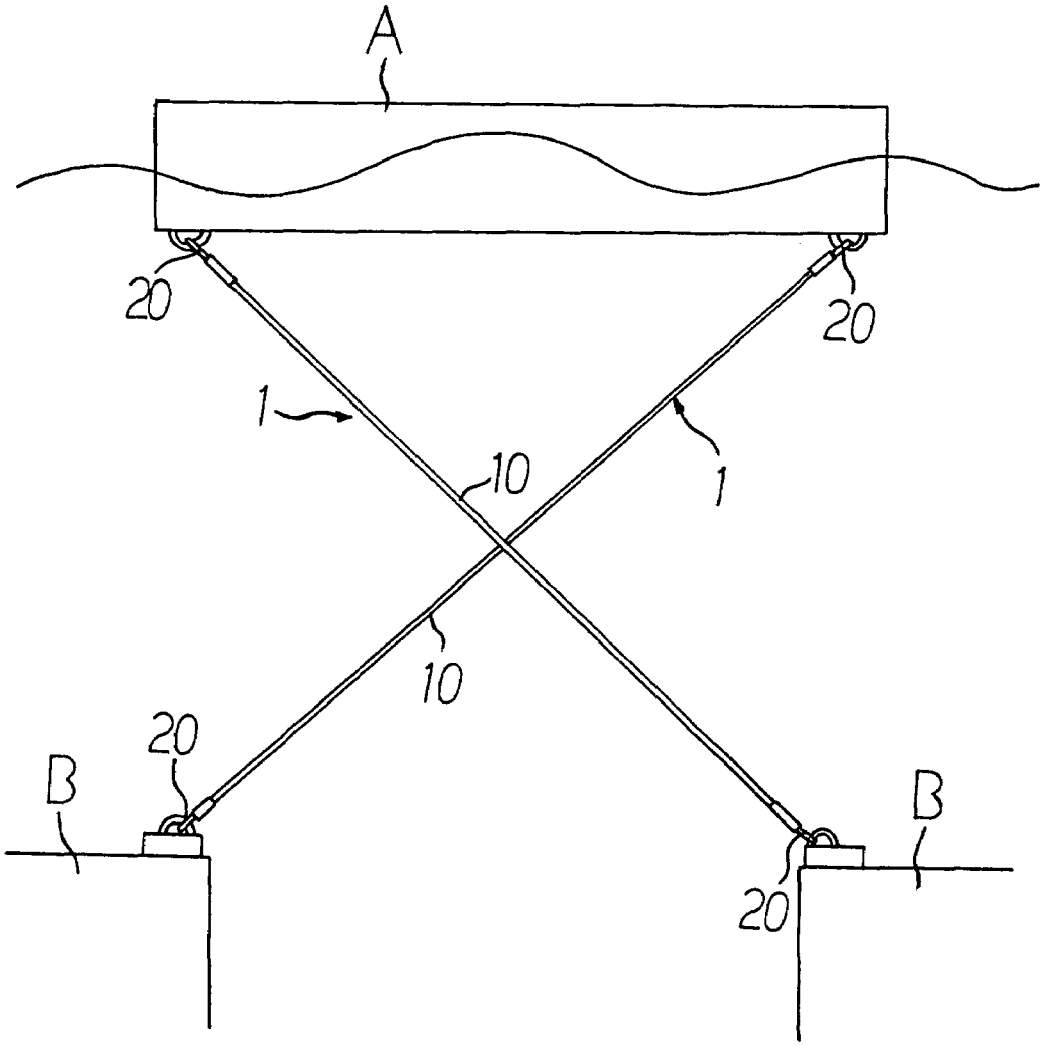
FIG. 1 is an illustrative diagram of the installation and use of the present invention.
Figure 2:
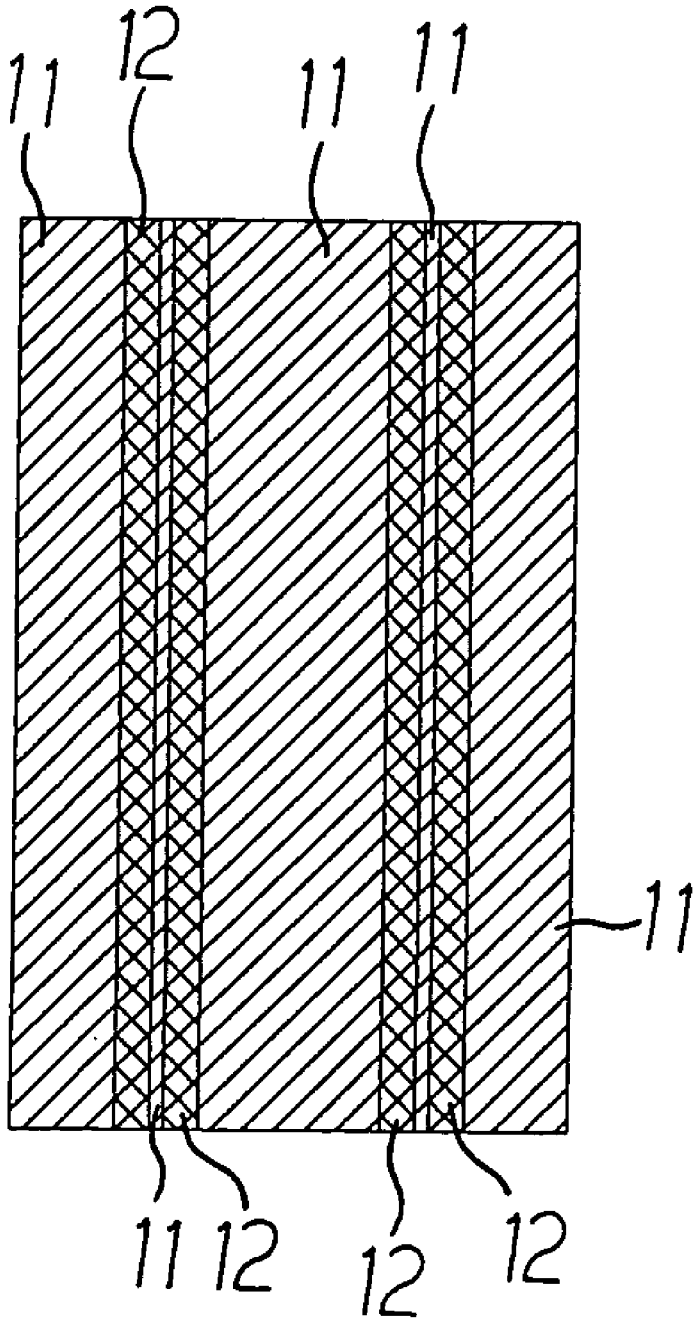
FIG. 2 is a cross-sectional diagram of the structure of the flexible anchoring rope of the present invention.

Please refer to FIGS. 1 and 2 for the overall structure and actual installation and use of the "Flexible Anchoring Rope" in accordance with this invention respectively. In the figures, a flexible anchoring rope 1 for fixing a floating platform A in the sea, consists of a structure made of a first layer of rubber with synthetic carbon fibers 11, a first layer of Kevlar fibers 12, a second layer of rubber with synthetic carbon fibers 11, a second layer of Kevlar fibers 12, and a third layer of rubber with synthetic carbon fibers 11 in the sequence from inside out; wherein the percentage of rubber content is about 50~60% and the percentage of synthetic fiber content is about 40~50%. The way of fixing these layers includes sticking the first layer of Kevlar fibers 12 on the outer surface of the first layer of rubber with synthetic carbon fibers 11 in the middle, sticking the second layer of rubber with synthetic carbon fibers 11 on top of the first layer of Kevlar fibers 12, sticking a second layer of Kevlar fibers 12 on the second layer of rubber with synthetic carbon fibers 11, and finally sticking the third layer of rubber with synthetic carbon fibers 11 on the second layer of Kevlar fibers 12. A fixture 20 disposed on each end of the flexible anchoring rope 10 is used to fix the floating platform A to an anchor B in the sea. Such arrangement gives the flexible anchoring rope 10 a better extensibility and tension-resistance as well as the resilience to improve the situation of traditional anchoring rope from being broken and the floating platform being drifted away due to the strong waves caused by storms.

Figure 3:
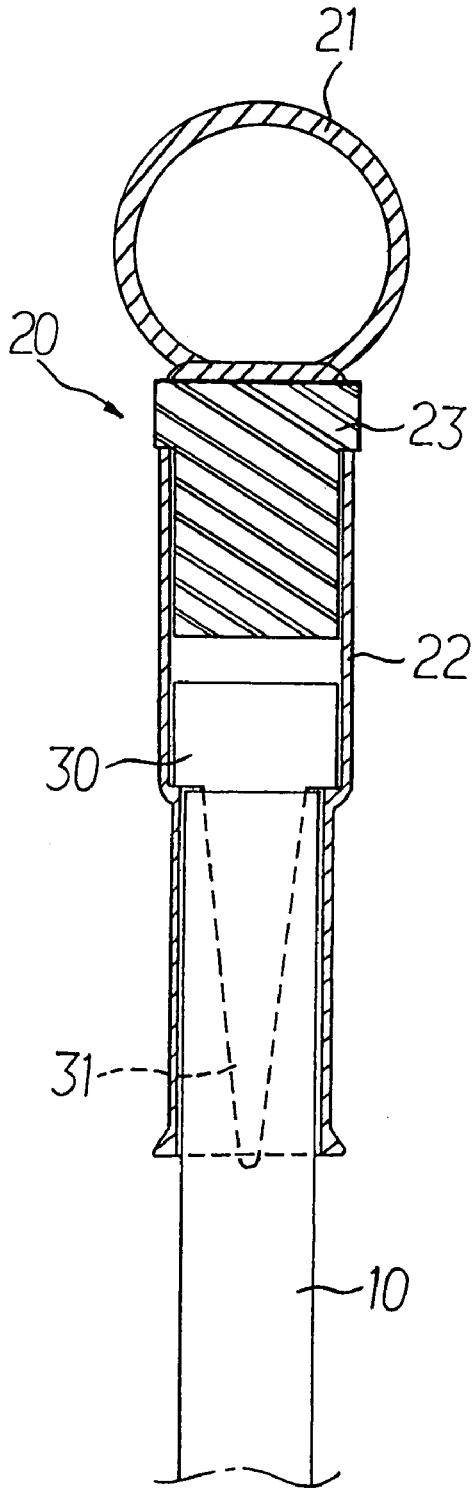
FIG. 3 is a cross-sectional diagram of part of the structure of the flexible anchoring rope of the present invention.
Figure 4:
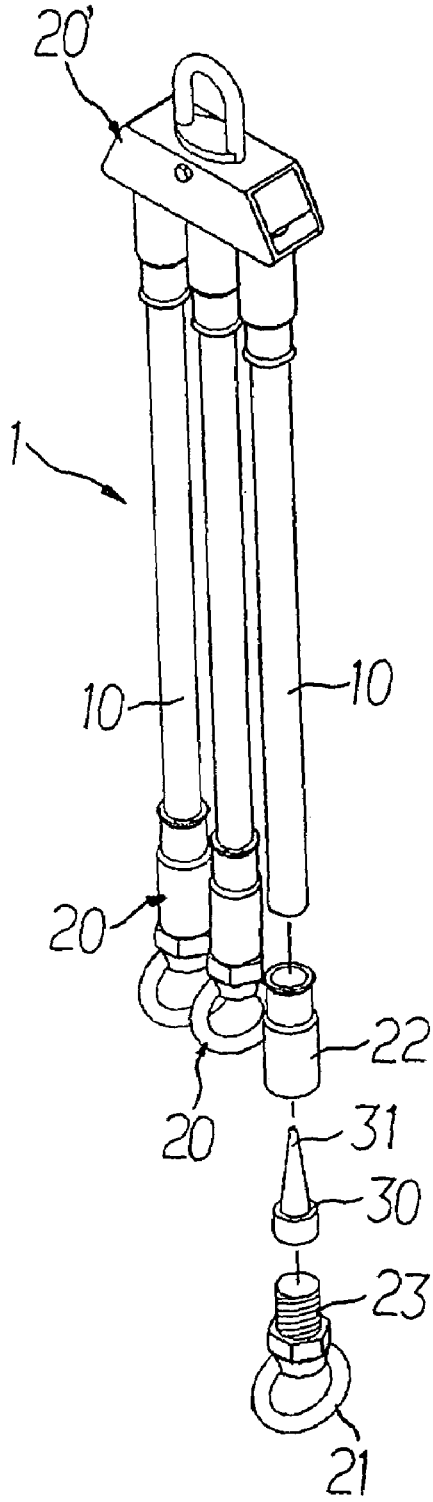
FIG. 4 is a perspective diagram of the disassembled parts of the fixture according to the present invention.

In FIG. 3, the fixture 20 comprises a fixed end 21, which could be a hanging ring, a connector 22, and a fixing screw 23. The fixed end 21 fixes the floating platform A to the anchor B. Please also refer to FIG. 4. During the assembling, the tip 31 of the insert latch 30 is inserted and fixed onto the end surface of the flexible anchoring rope first, and then the combined structure is placed inside the connector 22 of the fixture 20, and then the fixing screw 23 is used to fix the fixed end 21.

Figure 5:
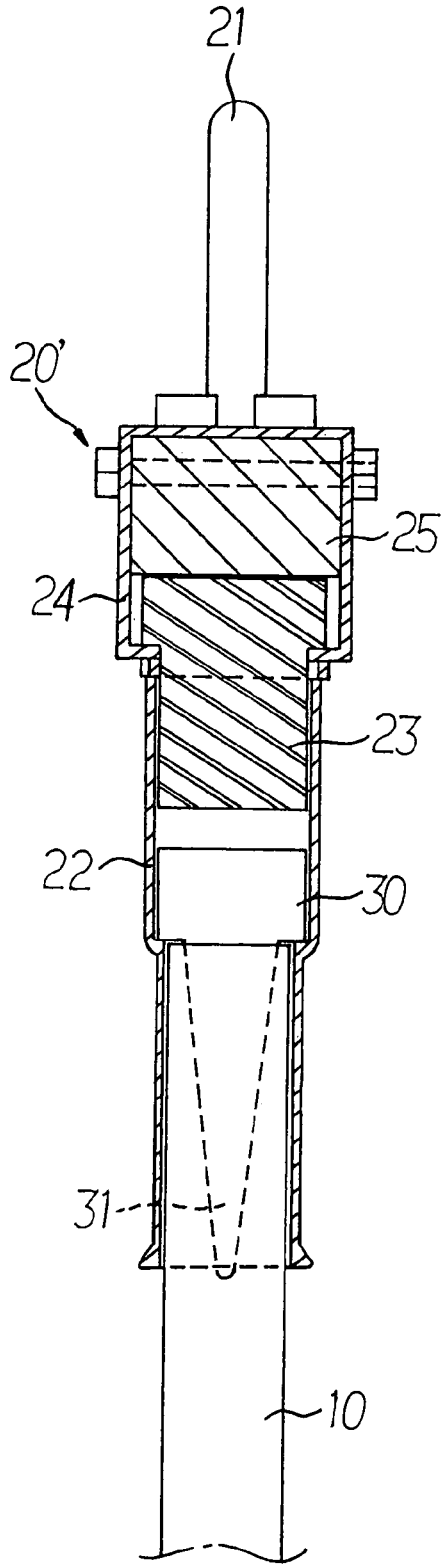
FIG. 5 is a cross-sectional diagram of part of the structure of the flexible anchoring rope according to another preferred embodiment of the present invention.
Figure 6:
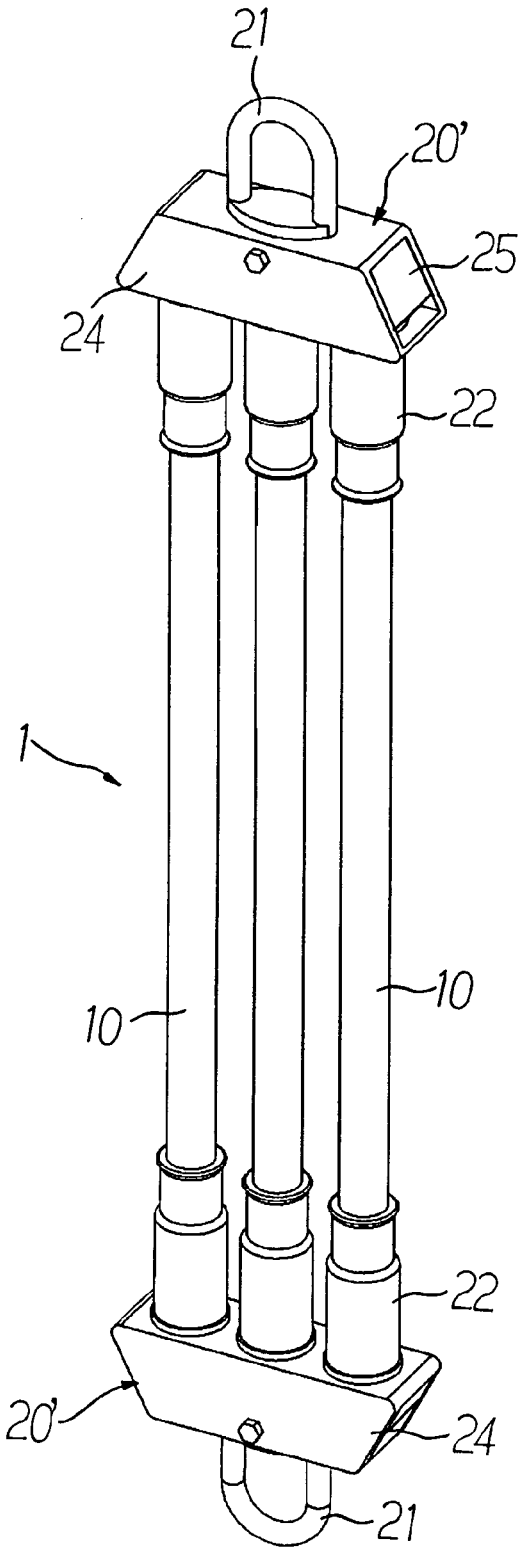
FIG. 6 is a perspective diagram of the flexible anchoring rope shown in FIG. 5.
Figure 7:
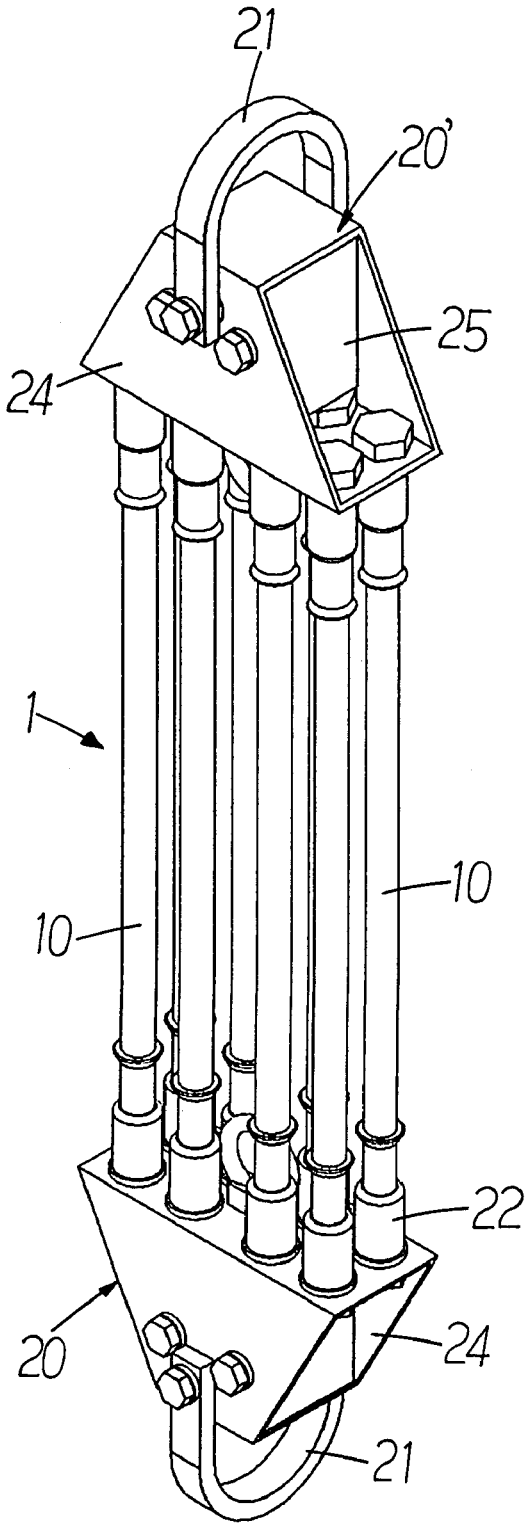
FIG. 7 is a perspective diagram of the structure of the flexible anchoring rope according to another preferred embodiment of the present invention.

The fixture 20' of this invention could be the one as shown in FIGS. 5 to 7, comprising a fixed end 21, a connector 22, a fixing screw 23, a connecting plate 24, and a cushion 25. The fixture 20' is also fixed by connecting an insert latch 30 with the flexible anchoring rope 10. Of course, it can be accomplished by connecting one or more flexible anchoring ropes 10 by the connecting plate 24.

Figure 8:
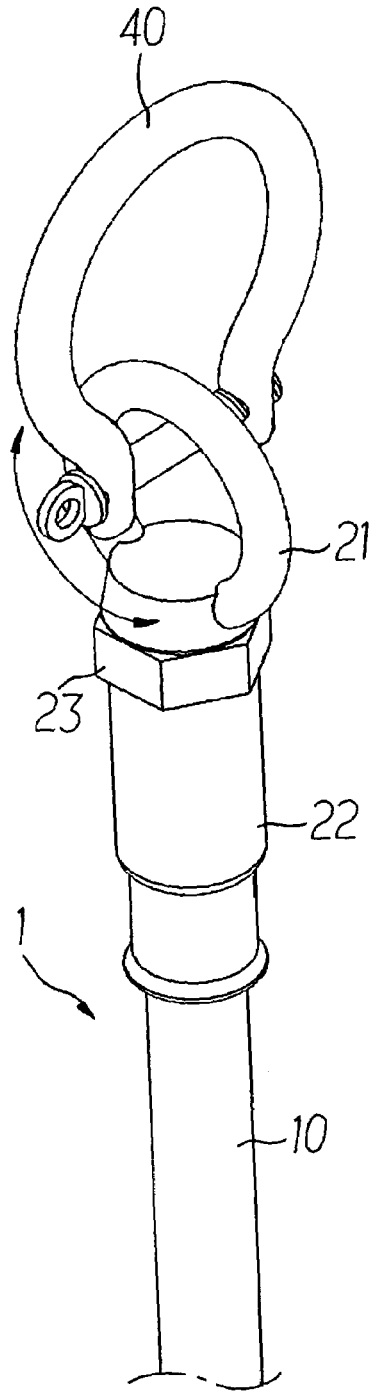
FIG. 8 is the perspective diagram of the partial structure of the flexible anchoring rope being connected with a rotary connector according to the present invention.
Figure 9:
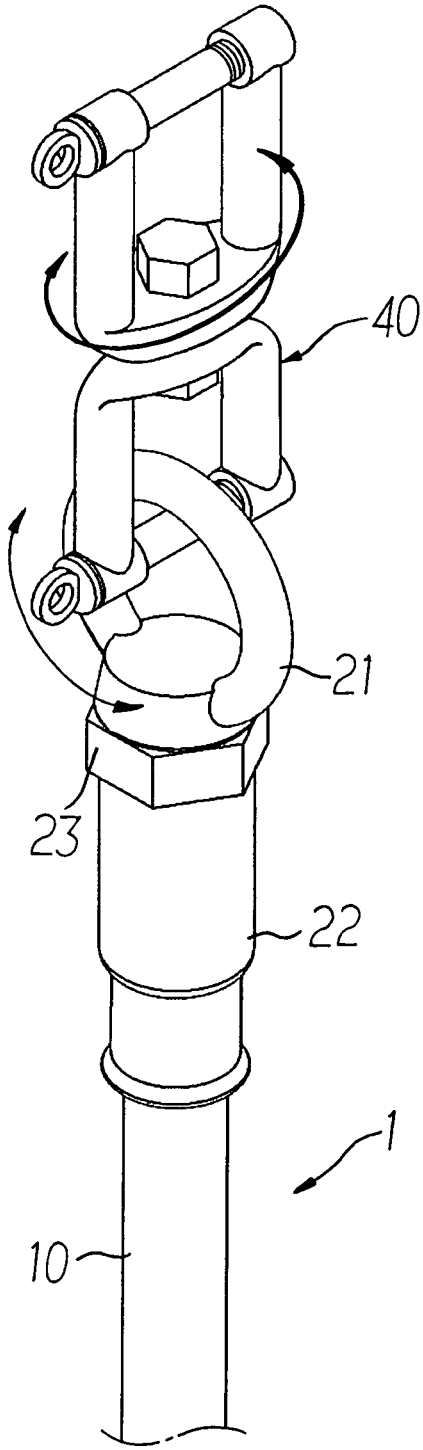
FIG. 9 is the perspective diagram of the partial structure of the flexible anchoring rope being connected with a rotary connector according to another preferred embodiment of the present invention.
Figure 10:
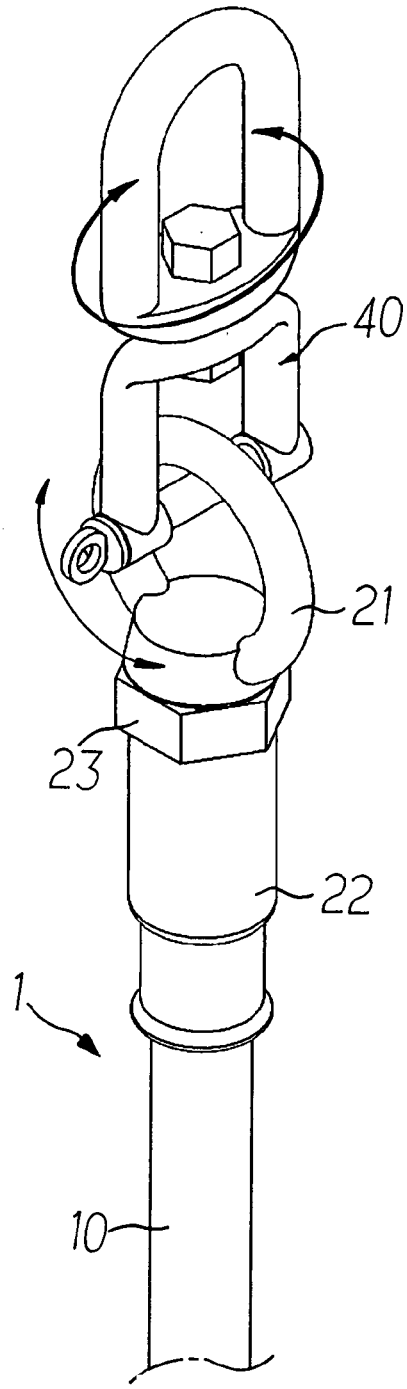
FIG. 10 is the perspective diagram of the partial structure of the flexible anchoring rope being connected with a rotary connector according to another further preferred embodiment of the present invention.

Further, the fixed end 21 of the fixture can be connected to a rotary connector 40, and then connected with the floating platform A and the anchor B, such that the flexible anchoring rope 1 can freely rotate at 360 degrees. The rotary connector 40 could be of any form as shown in FIGS. 8 to 10.

In summation of the above description, the present invention provides a flexible anchoring rope for fixing a floating platform at sea, and the good pre-stressed buffer provided by the flexible anchoring rope can sustain the tension produced by the tidal currents during the rising and ebb tides, and its good resilience can keep the floating platform in a specific area. Thus, the present invention enhances the performance than the conventional structure and further complies with the patent application requirements and is submitted to the Patent and Trademark Office for review and granting of the commensurate patent rights.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A flexible anchoring rope for fixing a floating platform in the water, comprising a structure made of rubber and synthetic carbon fibers in a predetermined percentage composition and wrapped in fibers, and a fixture disposed on each end of said flexible anchoring rope fixing the floating platform to an anchor in the water.

2. The flexible anchoring rope of claim 1, wherein said percentage composition of rubber is substantially 50~60% and said percentage composition of synthetic carbon fibers is substantially 40~50%.

3. The flexible anchoring rope of claim 1, wherein said structure is composed of a first layer of rubber with synthetic carbon fibers, a first layer of fibers, a second layer of rubber with synthetic carbon fibers, a second layer of fibers, and a third layer of fibers in the sequence from inside out.

4. The flexible anchoring rope of claim 1, wherein said fiber is a Kevlar fiber.

5. The flexible anchoring rope of claim 1, wherein said fixture further comprises a fixed end, a connector, and a fixing screw, such that said fixed end fixes the floating platform to an anchor.

6. The flexible anchoring rope of claim 1, wherein said fixture further comprises a fixed end, a connector, a fixing screw, a connecting plate, and a cushion.

7. The flexible anchoring rope of claim 5, wherein said fixed end of the fixture is coupled to a rotary connector, and then coupled to said floating platform and said anchor.

8. The flexible anchoring rope of claim 1, wherein said flexible anchoring rope is coupled to said fixture by an insert latch.

9. The flexible anchoring rope of claim 5, wherein said fixed end is a hanging ring.

10. The flexible anchoring rope of claim 6, wherein said connecting plate is coupled to at least one flexible anchoring rope.

11. The flexible anchoring rope of claim 6, wherein said fixed end of the fixture is coupled to a rotary connector, and then coupled to said floating platform and said anchor.

* * * * *